US007174759B2

(12) United States Patent
Massee

(10) Patent No.: US 7,174,759 B2
(45) Date of Patent: Feb. 13, 2007

(54) FORMING MACHINE AND METHOD FOR DEFORMING A HOLLOW WORKPIECE

(76) Inventor: Johan Massee, Vijfaprongweg 104, 6741 JC Lunteren (NL)

( * ) Notice: Subject to any disclaimer, the term of this patent is extended or adjusted under 35 U.S.C. 154(b) by 0 days.

(21) Appl. No.: 10/333,503

(22) PCT Filed: Jul. 20, 2001

(86) PCT No.: PCT/NL01/00565

§ 371 (c)(1),
(2), (4) Date: Jan. 20, 2003

(87) PCT Pub. No.: WO02/16058

PCT Pub. Date: Feb. 28, 2002

(65) Prior Publication Data

US 2003/0172701 A1 Sep. 18, 2003

(30) Foreign Application Priority Data

Jul. 21, 2000 (NL) ..... 1015773
Oct. 6, 2000 (NL) ..... 1016348

(51) Int. Cl.
*B21D 51/26* (2006.01)
*B21D 5/00* (2006.01)

(52) U.S. Cl. ..... 72/94; 72/82; 72/101; 72/125

(58) Field of Classification Search ..... 72/82, 72/84, 86, 94, 95, 101, 120, 121, 124, 125
See application file for complete search history.

(56) References Cited

U.S. PATENT DOCUMENTS 1,297,819 A 3/1919 Ferrier
1,500,261 A 7/1924 Page
2,358,307 A 9/1944 Dewey ..... 80/13
3,055,414 A 9/1962 Boldrini ..... 153/54
3,299,680 A * 1/1967 Thompson ..... 72/6.2

(Continued)

FOREIGN PATENT DOCUMENTS

| | | |
|---|---|---|
| DE | 1024046 | 2/1958 |
| DE | 3019723 | 12/1981 |
| DE | 4218092 C1 | 6/1993 |
| DE | 10013801 | 10/2001 |
| EP | 0125720 | 11/1984 |

(Continued)

OTHER PUBLICATIONS

U.S. Appl. No. 10/333,505, filed Jan. 20, 2003.
U.S. Appl. No. 10/333,502, filed Jan. 20, 2003.
EPO Opposition Communications for 0916428.
EPO Opposition Communications for 0916426.

*Primary Examiner*—Ed Tolan
(74) *Attorney, Agent, or Firm*—Westman, Champlin & Kelly P.A.; Steven M. Koehler

(57) ABSTRACT

The invention relates to a forming machine at least provided with a clamping device for clamping a hollow workpiece having at least one open end and a first forming tool which can be placed into contact with the outer surface of the workpiece and with which the workpiece can be deformed. The clamping device can be rotated about a first axis and moved with respect to this first axis. Thus, the forming machine can be of relatively straightforward design and operate at high rotational speeds, even when a tool head equipped with a relatively large number of rollers is being used. The invention further pertains to a method wherein the clamping device can be moved with respect to the said first axis.

13 Claims, 6 Drawing Sheets

U.S. PATENT DOCUMENTS

| | | | | |
|---|---|---|---|---|
| 3,340,713 | A | 9/1967 | Webb | 72/83 |
| 3,380,275 | A | 4/1968 | McGraw | 72/121 |
| 3,533,259 | A | 10/1970 | Marcovitch | 72/110 |
| 3,738,139 | A | 6/1973 | Proops et al. | 72/69 |
| 3,754,424 | A | 8/1973 | Costanzo | 72/105 |
| 3,851,515 | A | 12/1974 | Hautau | 72/121 |
| 3,874,209 | A | 4/1975 | Maiorino | 72/91 |
| 4,061,009 | A | 12/1977 | Kaporovich et al. | 72/69 |
| 4,091,648 | A | 5/1978 | McCaslin | 72/121 |
| 4,143,535 | A | 3/1979 | Bouman | 72/119 |
| 4,297,926 | A | 11/1981 | Russ et al. | 82/9 |
| 4,445,352 | A | 5/1984 | Pols | 72/101 |
| 4,563,887 | A | 1/1986 | Bressan et al. | 72/84 |
| 4,838,064 | A | 6/1989 | Pass | 72/84 |
| 5,372,028 | A | 12/1994 | Brilman et al. | 72/117 |
| 5,408,906 | A | 4/1995 | Gleason | 82/106 |
| 5,419,223 | A | 5/1995 | Kubler et al. | 82/118 |
| 5,570,603 | A | 11/1996 | Chatterley et al. | 72/101 |
| 5,571,541 | A | 11/1996 | Ochsebnbein et al. | 425/393 |
| 5,596,897 | A | 1/1997 | Payne | 72/84 |
| 5,758,532 | A | 6/1998 | Massee | 72/83 |
| 5,827,161 | A | 10/1998 | Petit | 493/102 |
| 5,901,595 | A | 5/1999 | Massee | 72/81 |
| 5,937,516 | A * | 8/1999 | De Sousa et al. | 29/890 |
| 5,996,386 | A * | 12/1999 | Pazzaglia | 72/84 |
| 6,018,972 | A | 2/2000 | Irie | 72/121 |
| 6,055,836 | A | 5/2000 | Waterworth et al. | 72/110 |
| 6,067,833 | A | 5/2000 | Irie | 72/121 |
| 6,216,512 | B1 * | 4/2001 | Irie | 72/121 |
| 6,233,933 | B1 | 5/2001 | Petty | 60/584 |
| 6,386,010 | B1 | 5/2002 | Irie et al. | 72/84 |

FOREIGN PATENT DOCUMENTS

| | | |
|---|---|---|
| EP | 0 916 426 A1 | 5/1999 |
| EP | 0 916 428 A2 | 5/1999 |
| FR | 1004843 | 4/1952 |
| JP | 57-134217 | 8/1982 |
| JP | 57202930 | 12/1982 |
| JP | 60261608 | 12/1985 |
| JP | 62-167956 | 7/1987 |
| JP | 63309333 | 12/1988 |
| JP | 4115803 | 4/1992 |
| JP | 10076401 | 3/1998 |
| JP | 10151501 | 6/1998 |
| PL | 157062 B | 4/1992 |
| WO | WO 02/062500 | 8/2002 |

* cited by examiner

FORMING MACHINE AND METHOD FOR DEFORMING A HOLLOW WORKPIECE

CROSS-REFERENCE TO RELATED APPLICATION

The present application is a national stage filing and claims priority of International patent application Ser. No. PCT/NL01/00565, filed Jul. 20, 2001, and published in English, the content of which is hereby incorporated by reference in its entirety. This application is also a continuation-in-part and claims priority of International patent application PCT/NL01/00563, filed Jul. 20, 2001, and published in English, the content of which is hereby incorporated by reference in its entirety.

BACKGROUND OF THE INVENTION

The invention relates to a forming machine at least comprising a clamping device for clamping down a hollow workpiece to be deformed, which has at least one open end, a first forming tool which can be placed into contact with the outer surface of the workpiece while the workpiece is being worked, and by means of which the workpiece can be deformed, driving means for rotating said workpiece and said tool about a first axis with respect to each other and means for moving the workpiece and the tool with respect to each other in such a manner that said tool can follow one or more desired paths with respect to the workpiece so as to work said workpiece. The invention furthermore relates to a method by means of which a hollow workpiece having at least one open end can be deformed.

Such an apparatus and method are known, for example from European patent application No. EP 0 916 428. Said publication discloses a forming machine, comprising a forming head fitted with a number of rollers, by means of which the diameter of one end of a cylindrical metal element can be reduced and, in addition, be bent through an angle.

To this end, the metal cylinder is clamped down and the forming head is rotated, whereupon the end is deformed by pressing the rollers in a radial direction against the outer surface of the metal cylinder and moving them along said outer surface in a number of cycles, whereby the radial distance between the rollers and their axis of rotation is decreased with each cycle. Since the axis of rotation is at an angle with the central axis of the non-deformed part of the metal cylinder, the end of the cylinder is not only reduced as a result of the movement in radial direction of the rollers, but in addition the end will also be positioned at an angle. Due to the use of the aforesaid cycles, the workpiece assumes the shape of the final product step by step.

EP 0 916 426 discloses a comparable forming machine and method, wherein the axis of rotation is eccentrically offset from the central axis of the metal cylinder. Thus a product is obtained wherein the central axis of the deformed portion is likewise offset from the central axis of the non-deformed portion of the metal cylinder.

The apparatus and method in hand can e.g. be used in the production of the housings of catalytic converters that form part of the exhaust system of vehicles, such as cars. Such catalytic converters have a diameter which is larger than the diameter of the pipes of the exhaust system of which they form part, and they are preferably positioned close to the engine block in order to reach their operating temperature as quickly as possible after the engine has been started and to maintain that temperature as much as possible. One consequence of this is that, first of all, the diameter of the connections on either side of the catalytic converter housing must be reduced in order to properly connect to the rest of the exhaust system, while in addition they need to have a complicated shape in many cases in order to enable an optimum position with respect to the engine block.

In the above-described apparatuses for producing workpieces having at least one deformed end, such as the above-described catalytic converter housings, the workpiece is held stationary, while the forming head is rotated. Since more and more complex shapes are being required, as already described above, there is a need for versatile and in some cases much larger forming heads. Furthermore, the number of rollers present on and controlled by a single forming head may increase (considerably).

It is an object of the present invention to provide an improved forming machine of the kind referred to in the introduction.

SUMMARY OF THE INVENTION

In order to accomplish that objective, the forming machine according to the invention includes a clamping device that can be rotated about said first axis and be moved with respect to said first axis. The method according to the invention includes the clamping device that is rotated and moved with respect to the aforesaid first axis.

Surprisingly it has become apparent that this allows a relatively simple construction of the forming machine, while it is furthermore possible to use high (relative) rotational speeds, also if a forming head comprising a relatively large number of rollers is used.

BRIEF DESCRIPTION OF THE DRAWINGS

The invention will now be explained in more detail with reference to the figures, which show a number of embodiments of the method and the apparatus according to the present invention.

DETAILED DESCRIPTION OF ILLUSTRATIVE EMBODIMENTS

Insofar as parts are identical to each other or have substantially the same function in the various embodiments, said parts will be indicated by the same numerals in all the figures.

Figure 1:
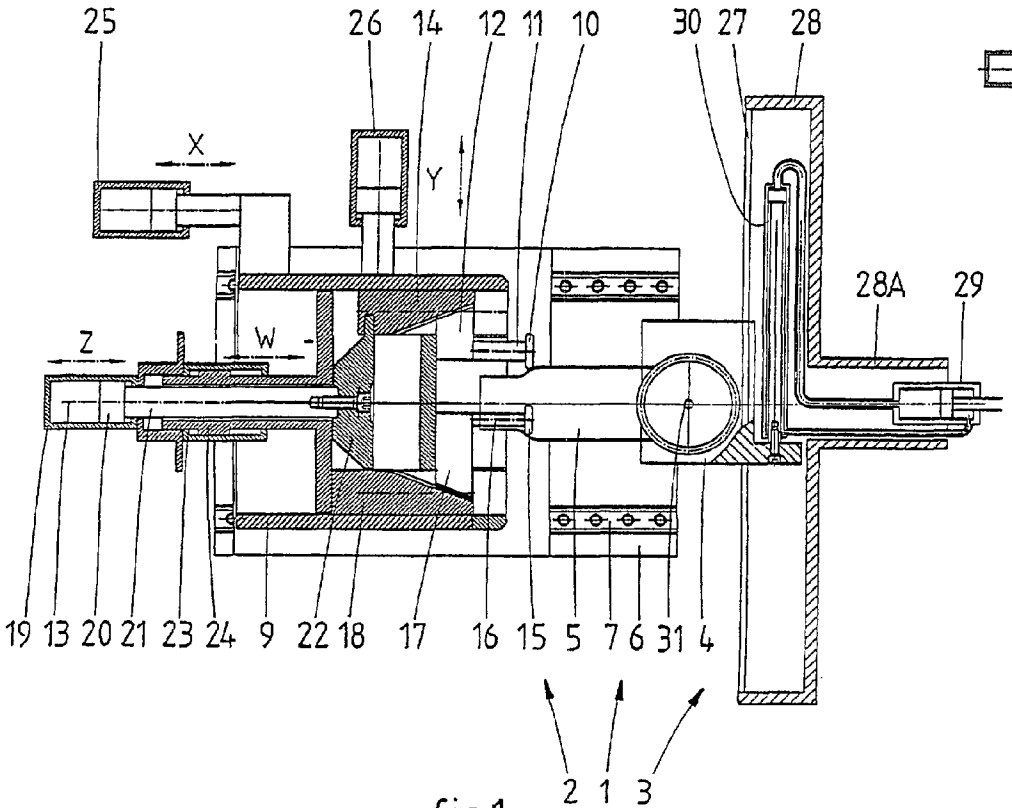

FIG. 1 shows a forming machine 1 comprising a forming head 2 and a clamping assembly 3 comprising a chuck 4 for clamping down the workpiece, for example the illustrated, already deformed metal cylinder 5. Forming head 2 comprises a baseplate 6, on which two guide rails 7 are mounted. Guides 8 (not shown) extend over said rails 7, on which guides a second set of guide rails (not shown) is mounted, which guide rails support an assembly 9 in which one or more forming rollers 10 and means for moving said forming rollers 10 are mounted.

Each of the forming rollers 10 is rotatably mounted on one end of a rod 11, which in turn is mounted on or forms part of a wedge-shaped element 12, which widens in the direction of forming rollers 10. Forming rollers 10 and their respective rods 11 and wedge-shaped elements 12 can each be moved radially inwards and outwards with respect to central axis 13 of assembly 9. To this end, each of the wedge-shaped elements 12 is mounted on a wedge-shaped guiding mandrel 14, whose thickness decreases linearly in the direction of forming rollers 10, in such a manner that wedge-shaped elements 12, and thus rods 11 and rollers 10, are forced radially towards axis 13 upon outward movement (to the right in the drawing) of mandrels 14, and radially away from said axis 13 upon inward movement (to the left in the drawing) thereof.

Assembly 9 furthermore comprises a forming roller 15 (hereinafter called inside roller 15), which is mounted in assembly 9 in substantially the same manner as forming rollers 10, i.e. rotatably mounted on one end of a rod 16, which in turn is mounted on or forms part of a wedge-shaped element 17, which widens in the direction of forming inside roller 15. Wedge-shaped element 17 is mounted on a wedge-shaped guiding mandrel 18, in such a manner that said element 17, and thus rod 16 and inside roller 15 are forced radially towards axis 13 upon outward movement of mandrel 18 and radially away from axis 13 upon inward movement thereof.

In FIG. 1, inside roller 15 has been moved into workpiece 5 and placed into contact with the inner wall of workpiece 5. The wall of workpiece 5 can be deformed in outward direction, i.e. in radial direction away from the cavity 5 defined by workpiece 5, by means of said inside roller 15. Forming rollers 10 and inside roller 15 preferably lie in the same plane, which plane extends perpendicularly to axis 13 in this embodiment, so that the wall is confined between said rollers 10, 15 at the location of the deformation.

Assembly 9 furthermore comprises an actuator, herein a hydraulic cylinder 19, which can move mandrels 15 axially and thus the forming rollers 10 radially by means of a piston 20, a piston rod 21 and a pressure plate 22. Within the framework of the present description, the radial movement of the forming rollers 10 will be indicated as the Z-direction.

Mandrel 18, and thus inside roller 15, can be moved in radial direction by means of an actuator, herein a hydraulic cylinder 23 and a hollow piston rod 24 surrounding piston rod 21, while assembly 9 can be moved along said guide in its entirety by means of actuators, herein two hydraulic cylinders 25 and 26. Within the framework of the present description, the radial movement of inside roller 15 will be indicated as the W-direction. Movements of assembly 9 and chuck 4 (yet to be described in more detail hereinafter) parallel to and perpendicularly to axis 13 will be indicated as the X-direction and the Y-direction, respectively.

Said chuck 4 is mounted in a guide slot 27 in a housing 28. Said housing 28 is rotatably mounted in a frame (not shown), and it furthermore comprises actuators, herein hydraulic cylinders 29, 30 for radial adjustment of chuck 4, a gauge (not shown) for measuring the radial movement of chuck 4, a gauge (not shown) for measuring the pivoting of chuck 4 and workpiece 5 about a pivot point 31 and a counterweight 32 for balancing the whole. Housing 28 comprises a circular cylindrical narrowing 28A on its rear side, which is e.g. provided with an external gear (not shown), which mates with a pinion mounted on the end of a drive shaft of an electric motor. Thus, housing 28, and with it chuck 4, can be rotated by means of a driver, for example by an electric motor, gear and pinion.

Figure 2:
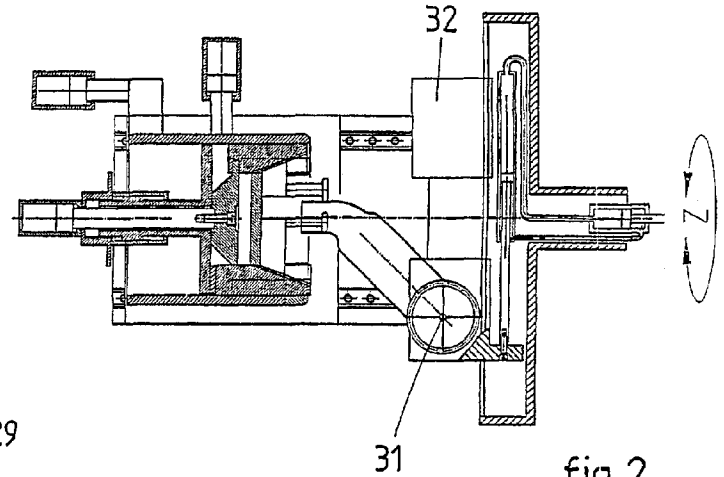
FIGS. 1–3 are schematic top plan views, partially in section, of a forming machine according to the present invention, comprising a rotatable chuck and a stationary forming head.
Figure 3:
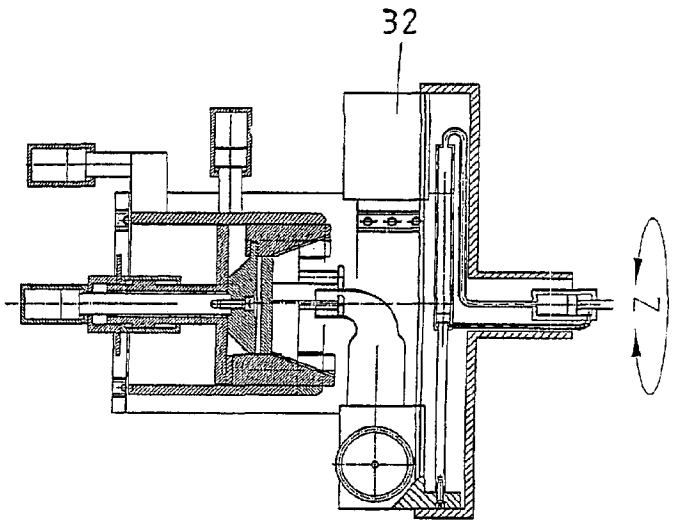
Figure 4:
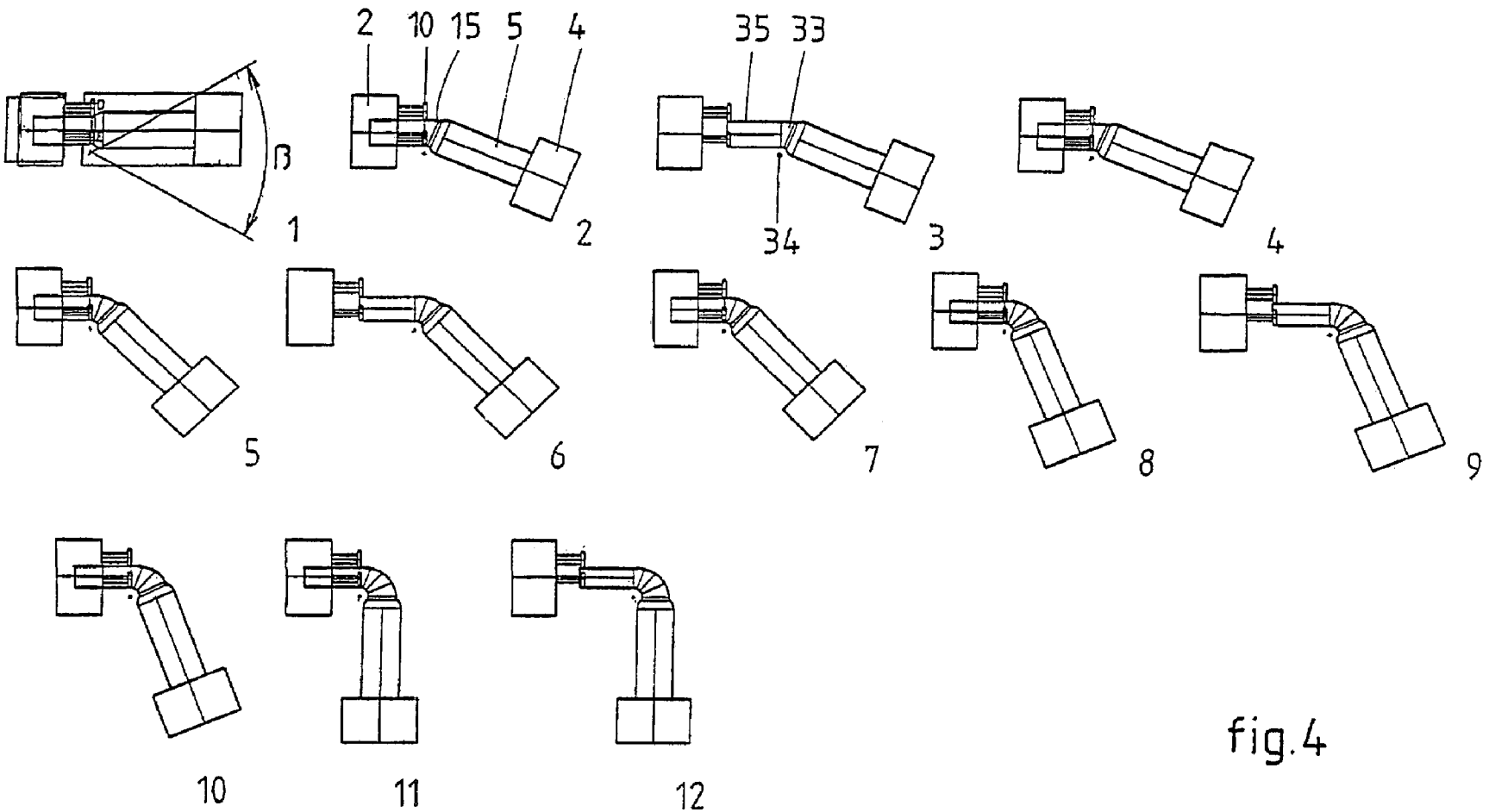
FIGS. 4 and 5 schematically show a number of stages of a method according to the present invention, carried out on the forming machine of FIG. 1.
Figure 5:
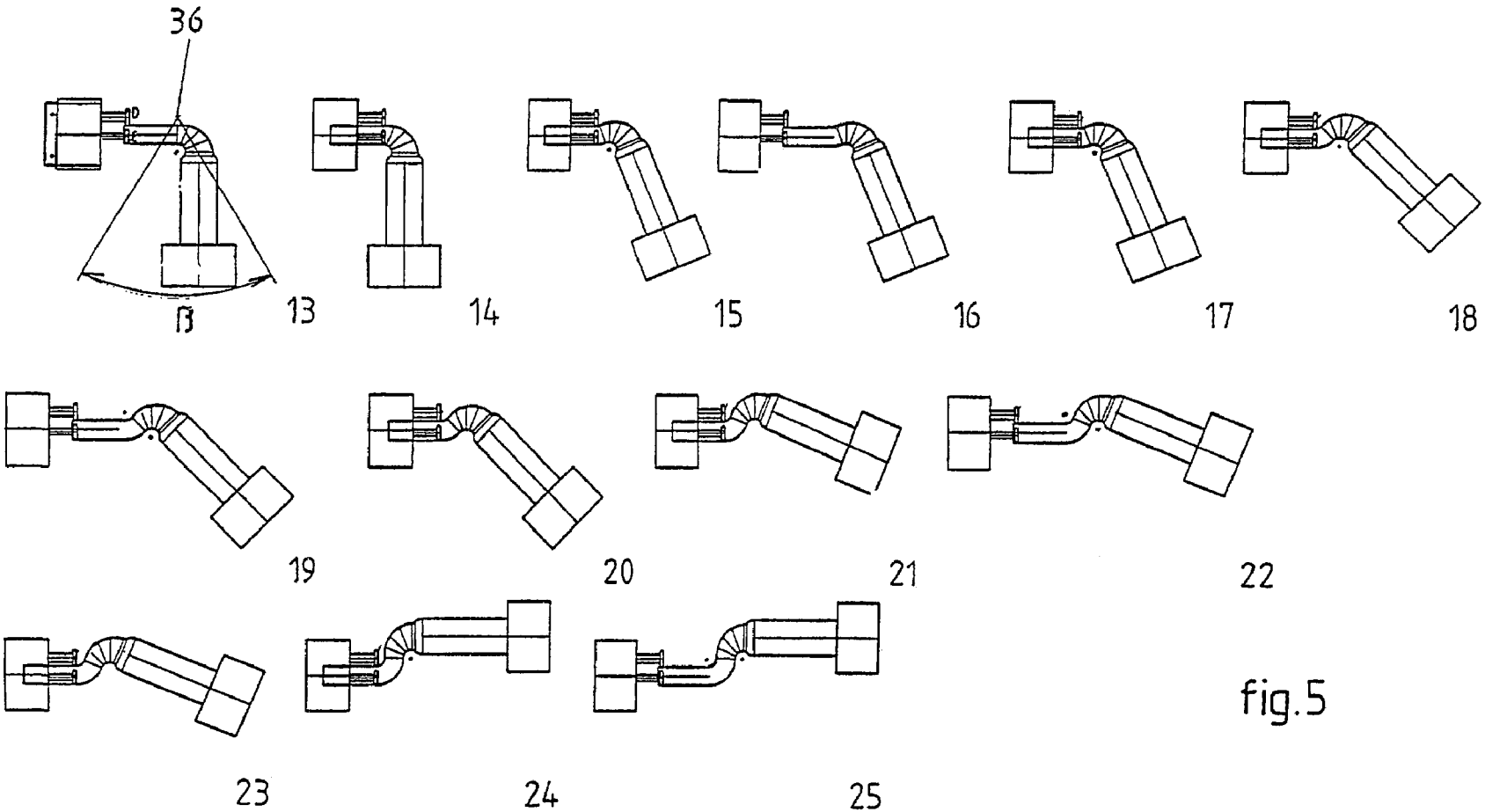
Figure 6:
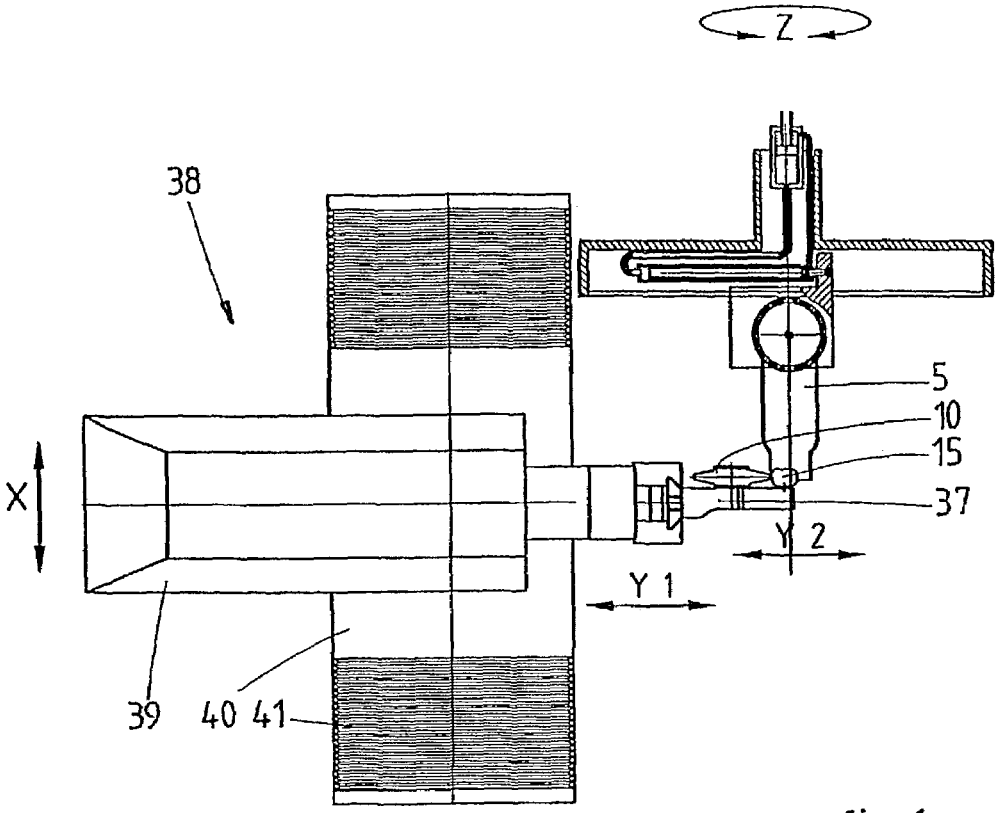
FIGS. 6–9 are schematic top plan views, partially in section, of a second embodiment of the forming machine according to the present invention, comprising a forming head which is positioned transversely to the axis of rotation of said chuck.
Figure 7:
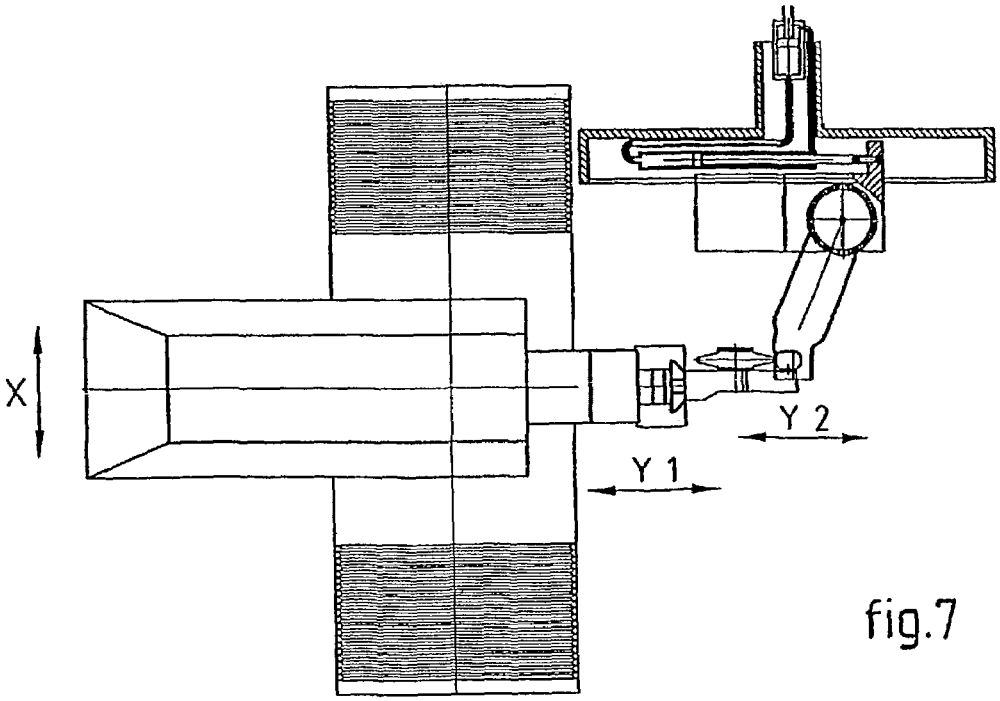
Figure 8:
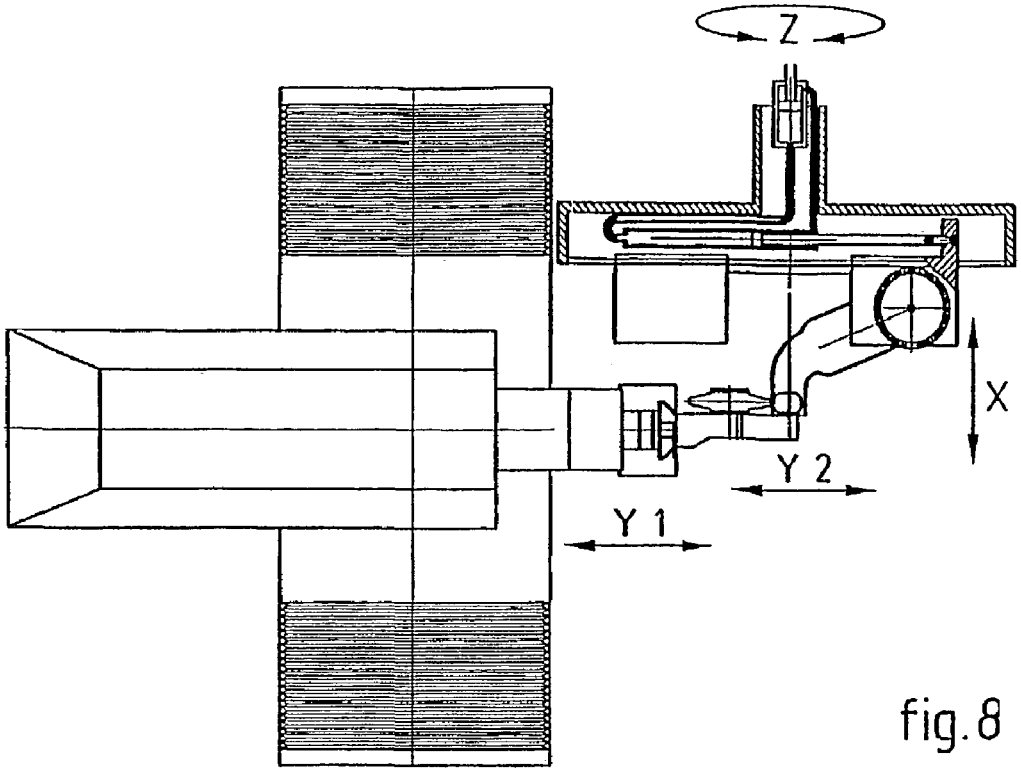
Figure 9:
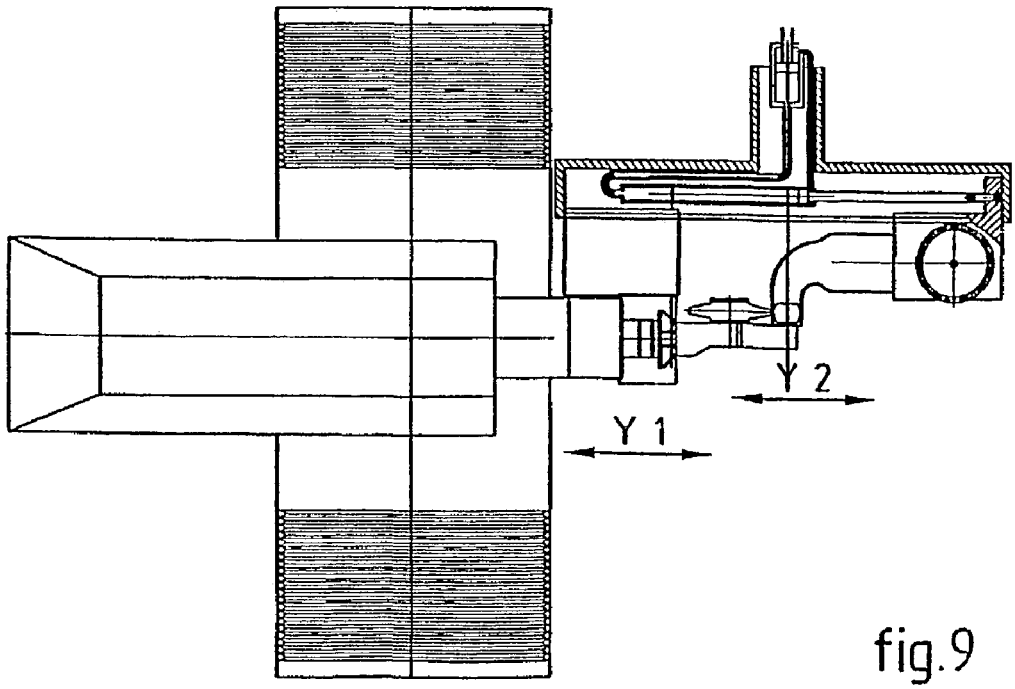

FIGS. 4 and 5 schematically show in 25 steps the manner in which an open end of a metal cylinder 5 can be deformed by means of forming head 2 of forming machine 1 according to FIGS. 1–3. Step 1 shows the starting position, wherein workpiece 5 is clamped down in a chuck 4. Said end, which has already undergone a machining step and which has a smaller diameter than the other part of cylinder 5, is then (step 2) deformed by rotating chuck 4 and placing the forming rollers 10, 15 into contact with, respectively, the outer surface and the inner surface of cylinder 5 and simultaneously pivoting chuck 4 through an angle β about pivot point 31. The various driving means are thereby controlled in such a manner that a composite, flowing movement of the forming rollers 10, 15 (in the Z-direction and the W-direction), assembly 9 (in the X-direction) and chuck 4 (through an angle β in the Y-direction) is obtained, as a result of which a portion 33 is formed which is bent through an angle β about an imaginary pivot point 34.

After chuck 4 has been pivoted through an angle β, the movement of the assembly 9 in the X-direction is continued (step 3), so that a cylindrical portion 35 remains, which portion has a smaller diameter (than during step 1) and which extends at an angle β with respect to the other part of cylinder 5.

Then (step 4) the forming rollers 10, 15 are moved radially outwards and radially inwards, respectively, so that the contact between said rollers 10, 15 and, respectively, the outer surface and the inner surface of the wall of cylinder 5 is broken. Assembly 9 is moved back along cylindrical portion 35 in the X-direction until the transition between the bent portion 33 and said cylindrical portion 35.

Forming rollers 10, 15 may be moved back into bent portion 33, whereby chuck 4 will be pivoted through a (usually small) portion of angle β and in the opposite direction (−β).

The above cycle is subsequently repeated by pivoting chuck 4 through an angle β, translating and adjusting assembly 9 (step 5, which is substantially identical to step 2) and translating assembly 9 in the X-direction (step 6, which is substantially identical to step 3), whereby the diameter of cylindrical portion 35 is further reduced. Then the contact between rollers 10, 15 and cylindrical portion 41 is broken, and the assembly is returned to the transition area between bent portion 33 and cylindrical portion 35 (step 7, which is substantially identical to step 4).

If forming rollers 10, 15 are moved back into bent portion 33 each time, as indicated above, and follow part of the preceding machining step (steps 2 and 5, respectively) upon commencement of the next machining step (in this case steps 4 and 7), the occurrence of unevennesses between the machined (in various steps) portions will be substantially prevented and a product having very smooth inside and outside walls will be obtained. A smooth inside wall is important in housings for catalytic converters, for example, in which disturbance of the flow of gases must be prevented as much as possible.

Depending on the characteristics of the workpiece, such as the wall thickness, the mechanical strength and stiffness and the elastic elongation, steps 2–4 are repeated until the desired reduction of the diameter and the desired angle, for example of 90°, have been obtained. If the nature of the workpiece involves that the angle β must not be larger than e.g. 15° or 8° per cycle, a total number of, respectively, 6 and 12 cycles will be required for the deformation of workpiece 5.

After the machining step as shown in FIG. 4, a comparable machining step is carried out, from the starting position as shown in FIG. 5 (step 13) and about a second imaginary pivot point 36 located on the other side of the workpiece. The machining step of FIG. 4 (steps 2–12) is repeated (steps 14–25), wherein the angle β is of opposite sense, however, so that an S-bend is obtained in the end of cylinder 5.

If chuck assembly 3 of forming machine 1 can furthermore pivot with respect to forming head 2, e.g. about an axis in the Y-direction, bending of workpiece 5 need not be restricted to bending in one and the same imaginary plane. Pivoting of forming head 2 in the Y-direction about said axis between or during machining steps makes it possible to impart a three-dimensional shape to the central axis of the deformed portion of workpiece 5.

FIGS. 6–9 shows four steps of a deforming operation carried out on a first variant of the forming machine 1 according to FIGS. 1–3, wherein advantageous use can be made of existing components. Forming rollers 10 and inside roller 15 are rotatably journalled in a holder 37. Holder 37 is supported in a known manner by an assembly 38 comprising a movable Y-slide (or upper slide) 39, which is present on a movable X-slide (or lower slide) 40. Lower slide 40 is translatably connected to machine bed 41 of assembly 38. Apart from the holder 37 and a separate control and drive of the parts of holder 37 on which the respective forming rollers 10 and 15 are mounted and by means of which said rollers can be moved independently in the Y-direction (Y1, Y2), it is possible in principle to use an existing assembly of an existing forming machine.

Figure 10:
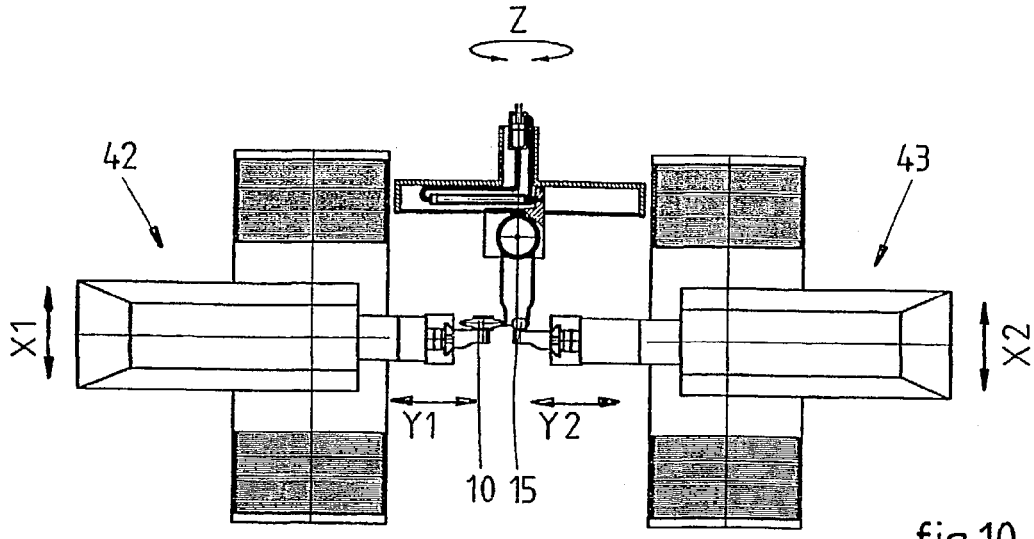
FIGS. 10–12 are schematic top plan views, partially in section, of a variant of the forming machine according to FIGS. 6–9.
Figure 11:
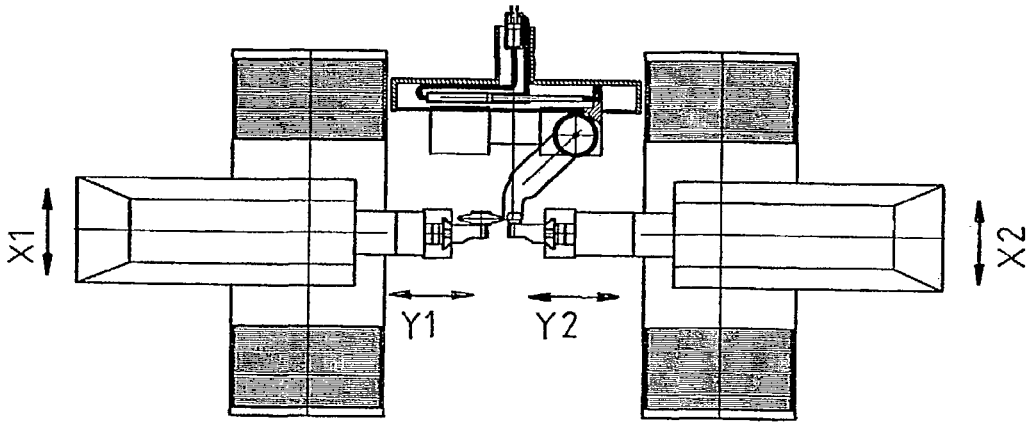
Figure 12:
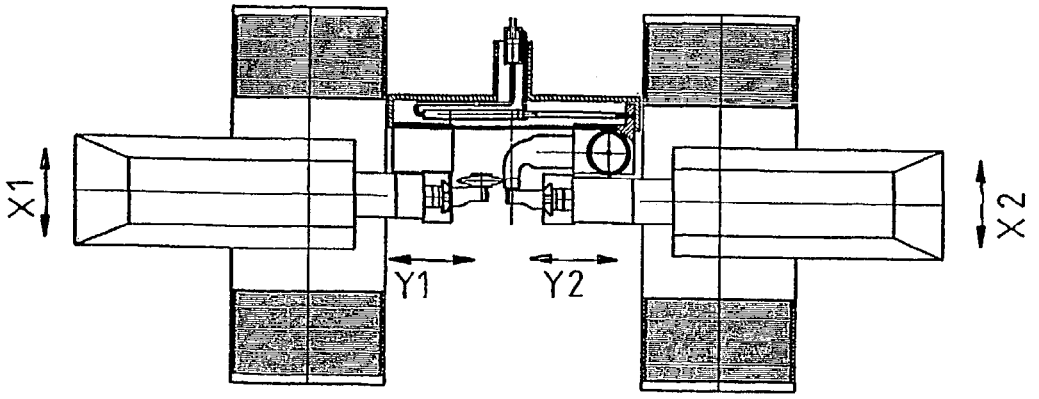

If it should be desired to modify existing equipment even less, or not at all, a second variant of the forming machine 1 according to FIGS. 1–3 can be used, which variant is shown in FIGS. 10–12 and which comprises two separate assemblies 42, 43, each carrying a respective forming roller 10, 15. In principle, it will suffice to adapt the control software when such an arrangement is used. Suitable existing assemblies are e.g. disclosed in the applicant's Dutch patent application No. 1000851 and in European patent application No. 0 125 720.

Although the deforming head that is used in the above-described examples remains rotationally stationary in all cases, it is possible, of course, to provide driving means for rotating the deforming head. If the deforming head is rotated in a direction opposed to the direction of rotation of the chuck, the number of revolutions of the latter can be reduced without the relative rotational speed decreasing. Such a construction can also be used for machining operations wherein exceptionally high relative rotational speeds are desired. In that case the number of revolutions of the chuck will not be decreased, or only to a small degree.

The forming machines according to the present invention can be operated by a person as well as by a control unit, of course. Such a control unit is for example arranged for controlling the means for moving the rollers in X-direction, Y-direction and radial direction in accordance with a control program that is stored in a memory, in such a manner that the forming rollers follow one or more desired paths for deforming the workpiece into the desired product or intermediate product.

Although the invention has been explained on the basis of a cylindrical metal workpiece in the foregoing, it is also possible to implement the invention on workpieces of unround section, such as an oval, a substantially triangular or a multilobal section.

The invention is not restricted to the above-described embodiments, which can be varied in several ways without departing from the scope of the invention as defined in the claims.

The invention claimed is:

1. A forming machine comprising a clamping device for clamping down a hollow workpiece to be deformed, which has at least one open end, a first forming tool which is placeable into contact with the outer surface of the workpiece while the workpiece is being worked, and by means of which the workpiece is deformable, driving means for rotating said workpiece and said first forming tool with respect to each other about a first axis and means for moving said workpiece and said first forming tool with respect to each other, in such a manner that said first forming tool is able to follow one or more desired paths with respect to the workpiece so as to work said workpiece, wherein said clamping device is spinable about said first axis and is able to translate radially and/or to pivot with respect to said first axis.

2. The forming machine according to claim 1, wherein at least that part of the clamping device in which the workpiece is clamped down is able to pivot about a second axis.

3. The forming machine according to claim 2, wherein said second axis and said first axis intersect at a substantially right angle.

4. The forming machine according to claim 1, wherein said clamping device is movable and/or is able to be pivoted during rotation.

5. The forming machine according to claim 4, wherein said clamping device is mounted in a housing which is spinable about said first axis by said driving means, and which comprises a guide which extends substantially perpendicularly to said first axis, along which said claming device is translatable.

6. The forming machine according to claim 5, wherein a counterweight is mounted in said housing, which counterweight is positioned substatitially diametrically opposite said clamping device.

7. The forming machine according to claim 1, wherein said forming machine comprises at least one second forming tool, being insertable into the workpiece and placed into contact with the inner wall of the workpiece, in such a manner that said wall is deformable in an outward direction.

8. The forming machine according to claim 7, wherein said first and second forming tools are mounted on at least one holder, which holder is positioned beside said first axis.

9. The forming machine according to claim 8, wherein said first and second forming tools are mounted on the same holder.

10. A method for deforming a hollow workpiece having at least one open end, wherein the workpiece is clamped down in a clamping device, a first forming tool is placed into contact with the outer surface of the workpiece, said workpiece and said first forming tool are spun about a first axis with respect to each other and the workpiece is deformed by means of said first forming tool, wherein said clamping device is spun and translated radially and/or pivoted with respect to said first axis.

11. The method according to claim 10, wherein at least that part of the clamping device in which the workpiece is clamped down is pivoted about a second axis.

12. The method according to claim 11, wherein said second axis and said first axis intersect at a substantially right angle.

13. The method according to claim 10, wherein a second forming tool is placed into the cavity defined by the workpiece and into contact with the inner surface of the hollow workpiece, and wherein the workpiece is deformed by means of said second forming tool.

* * * * *